United States Patent [19]

Conrad

[11] Patent Number: 4,889,261

[45] Date of Patent: Dec. 26, 1989

[54] BEVERAGE CONTAINER AND DISPENSER

[75] Inventor: George R. Conrad, Dunwoody, Ga.

[73] Assignee: General Electric Company, Mt. Vernon, Ind.

[21] Appl. No.: 203,832

[22] Filed: Jun. 8, 1988

[51] Int. Cl.[4] ..... B67D 5/60

[52] U.S. Cl. ..... 222/130; 222/192; 221/96; 206/499; 206/514; 220/23.83; 215/10

[58] Field of Search ..... 222/185, 192, 129, 143, 222/130; 221/96, 282, 312 R; 206/514, 499; 220/23.83, 23.86, 23.2; 215/10

[56] References Cited

U.S. PATENT DOCUMENTS

| | | | |
|---|---|---|---|
| 2,570,283 | 10/1951 | Stevens | 222/129 X |
| 3,331,533 | 7/1967 | Krugger | 221/96 |
| 3,349,960 | 10/1967 | Ketler | 221/96 |
| 3,369,688 | 2/1968 | Dike | 215/10 |
| 3,434,629 | 3/1969 | Hooge et al. | 221/96 X |
| 3,469,739 | 9/1969 | Phillips | 221/96 |
| 3,604,592 | 9/1971 | Bacon | 222/192 X |
| 4,592,478 | 6/1986 | Laconis | 215/10 X |
| 4,609,106 | 9/1986 | Gentili | 215/10 X |

*Primary Examiner*—Kevin P. Shaver
*Assistant Examiner*—Gregory L. Huson
*Attorney, Agent, or Firm*—Martin B. Barancik; Joseph T. Eisele

[57] ABSTRACT

An assembly for the containment and dispensing of a beverage includes a portable container fabricated from a pressure deformable, synthetic polymeric resin. An integrally molded projection of the container wall is used to mount one or more drinking vessels such as cups. A single chamber is defined by the container wall, including the projection and functions to contain the beverage to be dispensed. The structure of the container is highly compact, with minimal interior space not utilizable by beverage containment. This avoids an imbalance of the container when it is carried from place to place.

7 Claims, 7 Drawing Sheets

FIG. 7
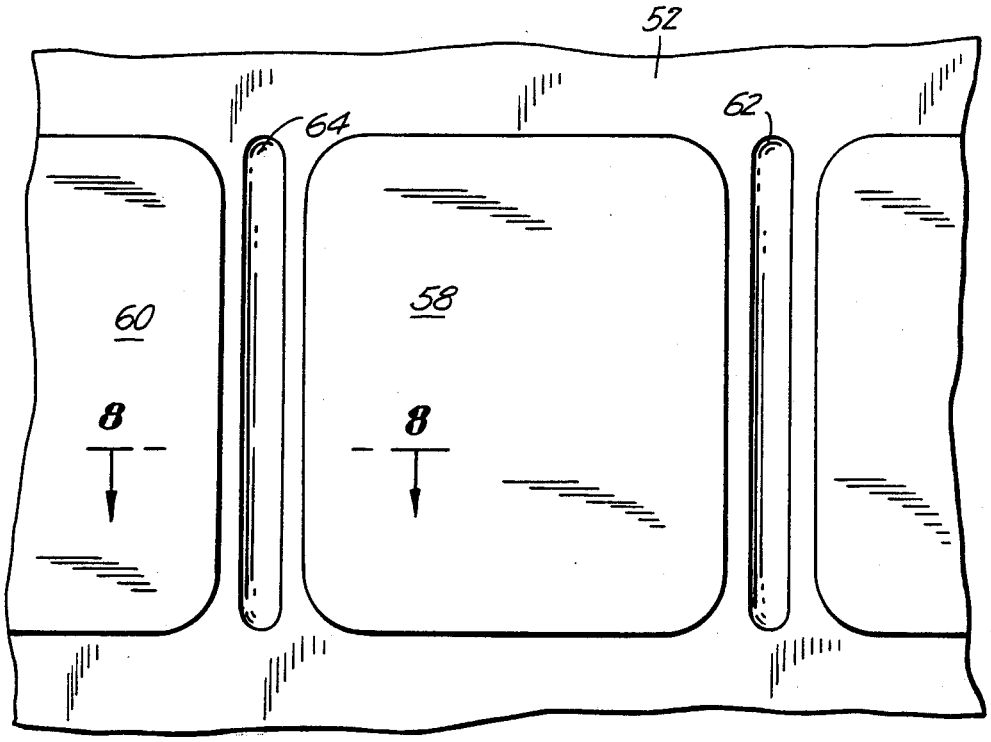
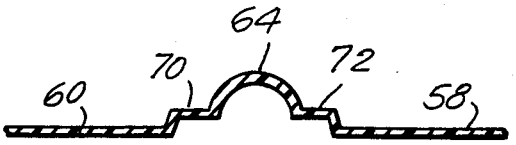
FIG. 8

BEVERAGE CONTAINER AND DISPENSER

BACKGROUND OF THE INVENTION

1. Field of the Invention

The invention relates to containers for the containment of a liquid and more particularly to an assembly for both the containment and dispensing of beverages.

2. Description of the Prior Art

Vessels for containing and transporting beverages are described in man's earliest writings, as also are drinking or dispensing vessels. However, the demand for modern packaging includes a need for compact, readily packaged and transported assemblies which are light-weight and labor saving in both transporting, use and convenience. The assemblies of the present invention meet the goals and requirements of modern life.

SUMMARY OF THE INVENTION

The invention comprises a portable assembly for the containment and dispensing of a beverage, which comprises;

(A) a hollow body of pressure deformable, synthetic polymeric resin, said body having 1. a first closed end;
2. a second closed end;
3. a continuous body skin joining the first and second ends, said skin being defined by and intermediate of an inner skin surface and an outer skin surface; and
4. a projected portion of the skin, restricted to a selected site on the body;

(B) a closed chamber defined by the inner surface of the skin, for containment of the beverage;

(C) a port through the skin, providing fluid communication between the chamber and the outer surface of the skin;

(D) removable closure means mounted in the port, for opening and closing the fluid communication; and (E) a drinking vessel removably mounted on the outer skin surface of the projected portion of the skin.

BRIEF DESCRIPTION OF THE DRAWINGS

FIG. 7 is a fragmentary view from the side of another embodiment assembly of the invention.

FIG. 8 is a cross-sectional view along lines 8—8 of FIG. 7.

DETAILED DESCRIPTION OF THE PREFERRED EMBODIMENTS OF THE INVENTION

A complete understanding of the invention may be readily obtained from the following description of the preferred embodiments when read in conjunction with the accompanying drawings of FIGS. 1-8, inclusive.

Figure 1:
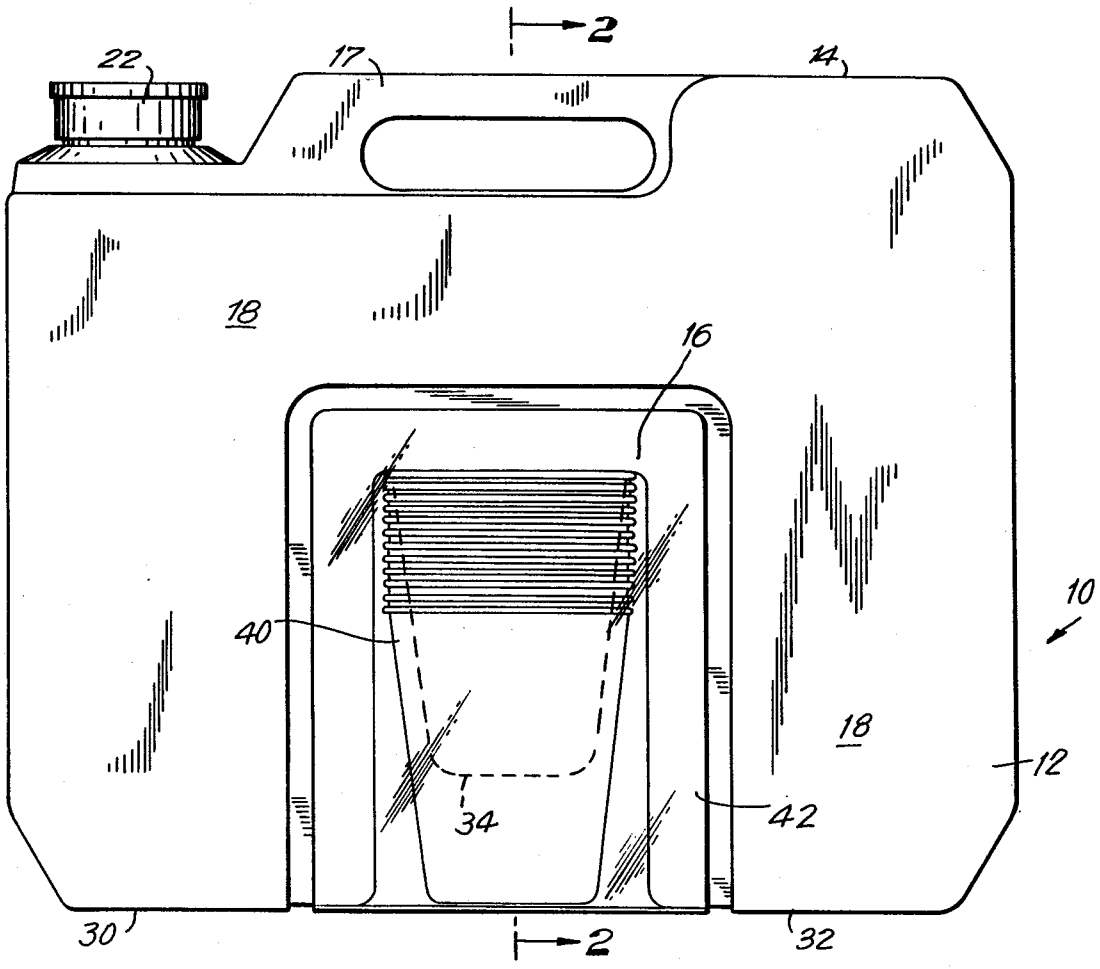
FIG. 1 is a side elevation of a preferred embodiment assembly of the invention.

Referring first to FIG. 1, there is seen a side elevation of an embodiment assembly 10 of the invention. The container 12 component of assembly 10 may be a relatively thin-walled (pressure deformable) mono or multilayered container fabricated from synthetic, polymeric resins such as polycarbonate, polypropylene, ethylene vinyl alcohol, polyethylene terephthalate, polyvinyl chloride and the like. The techniques for fabricating container 12 are well known to those skilled in the art and details need not be recited herein. As one example, blow molding techniques may be used. The container 12 may be fabricated in any desired size and will preferably have a generally tubular shape with a closed end 14 and closed end 16. An integrally blow molded hand grip 17 is located on end 14. The ends 14,16 are joined together by a body skin 18. The ends 14,16 together with skin 18 define and enclose an interior chamber 20 (see FIG. 2) for the containment of a beverage to be packaged therein.

The end 14 of container 12 has a portal for access to chamber 20 and the liquid contents, which is closed with a removable closure 22 of a fluid-proof material, such as a gas-proof synthetic resin, metal or the like. The closure 22 is preferably removably mounted in the portal through the agency of threads on the outer surface of the skin 18, which threads matingly engage with corresponding threads on the inner aspect of the closure 22. However, any conventional means may be employed to secure closure 22 in place on the portal. The closure 22, which may be fabricated from metal or a synthetic polymeric resin such as a polycarbonate, screws downward on the threads to close the chamber 20. The closure 22 may be unthreaded from its engagement with the threads unsecuring the closure 22 which may be removed for access to the chamber 20. Projecting downwardly from the body of the container 12 at the end 16 are skin 18 projections 30, 32 and 34. The projections 30, 32 serve as legs to support the container 12 on a surface in a stable manner. The projection 34 however does not extend downwardly as far as the projections 30, 32 and its function is different. The projection 34 functions by its size and configuration to mount a plurality of conventional drinking cups 40, nested together. The conventional drinking cups 40 are second components of the assembly 10 of the invention. The nested cups 40 are mounted by an interference fit on the frusto-conical shaped projection 34. A transparent covering membrane 42 encloses the cups 40 upon their mounting to keep them clean and secure for transporting the assembly 10. The membrane 42, which may be fabricated from any flexible sheet material such as a film of a synthetic polymeric resin, may bear indicia to identify the contents of the container 12. An adhesive may be used to secure the membrane 42 in place by bonding it to the skin 18 at selected sites. Access to the cups 40 may be had by removal of the membrane 42.

Figure 2:
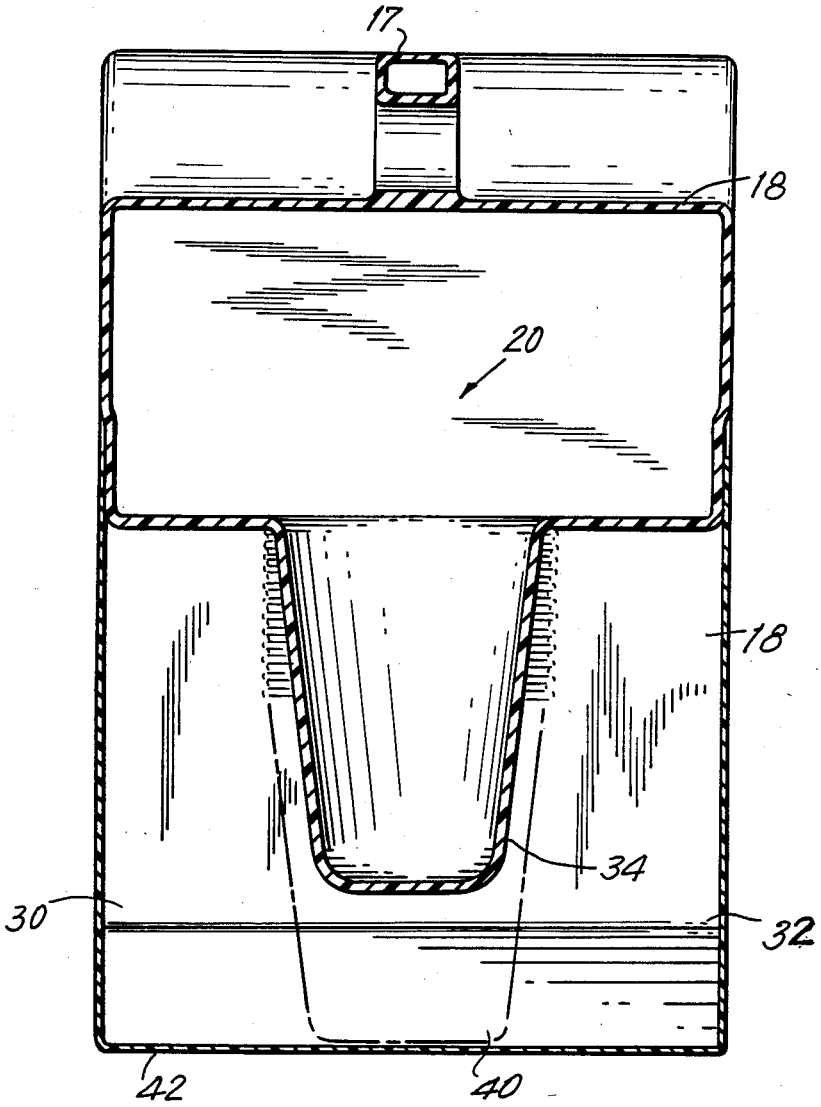
FIG. 2 is a cross-sectional view along lines 2—2 of FIG. 1.

FIG. 2 is a cross-sectional view along lines 2—2 of FIG. 1 and shows further detail of the assembly 10, including inner surface 44 and outer surface 46 of the skin 18 which defines the chamber 20.

Figure 3:
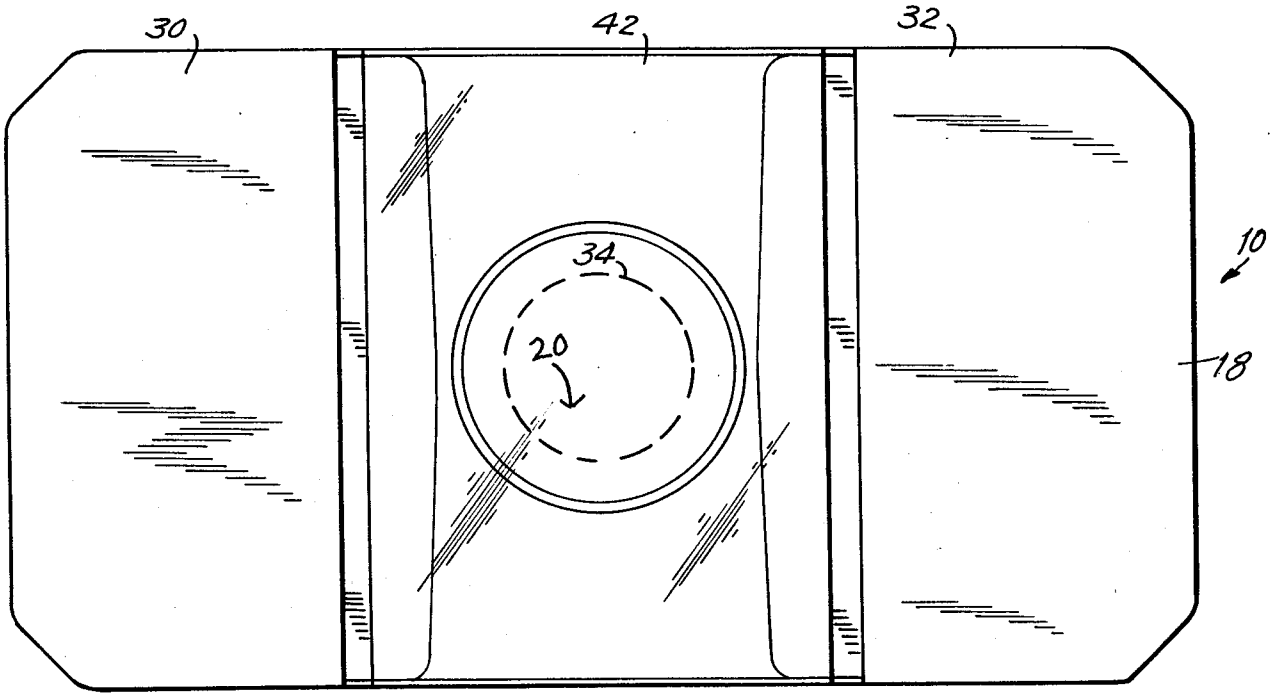
FIG. 3 is a bottom view of the embodiment assembly shown in FIG. 1.

FIG. 3 is a bottom view of the assembly 10 of the invention and shows further details.

Figure 4:
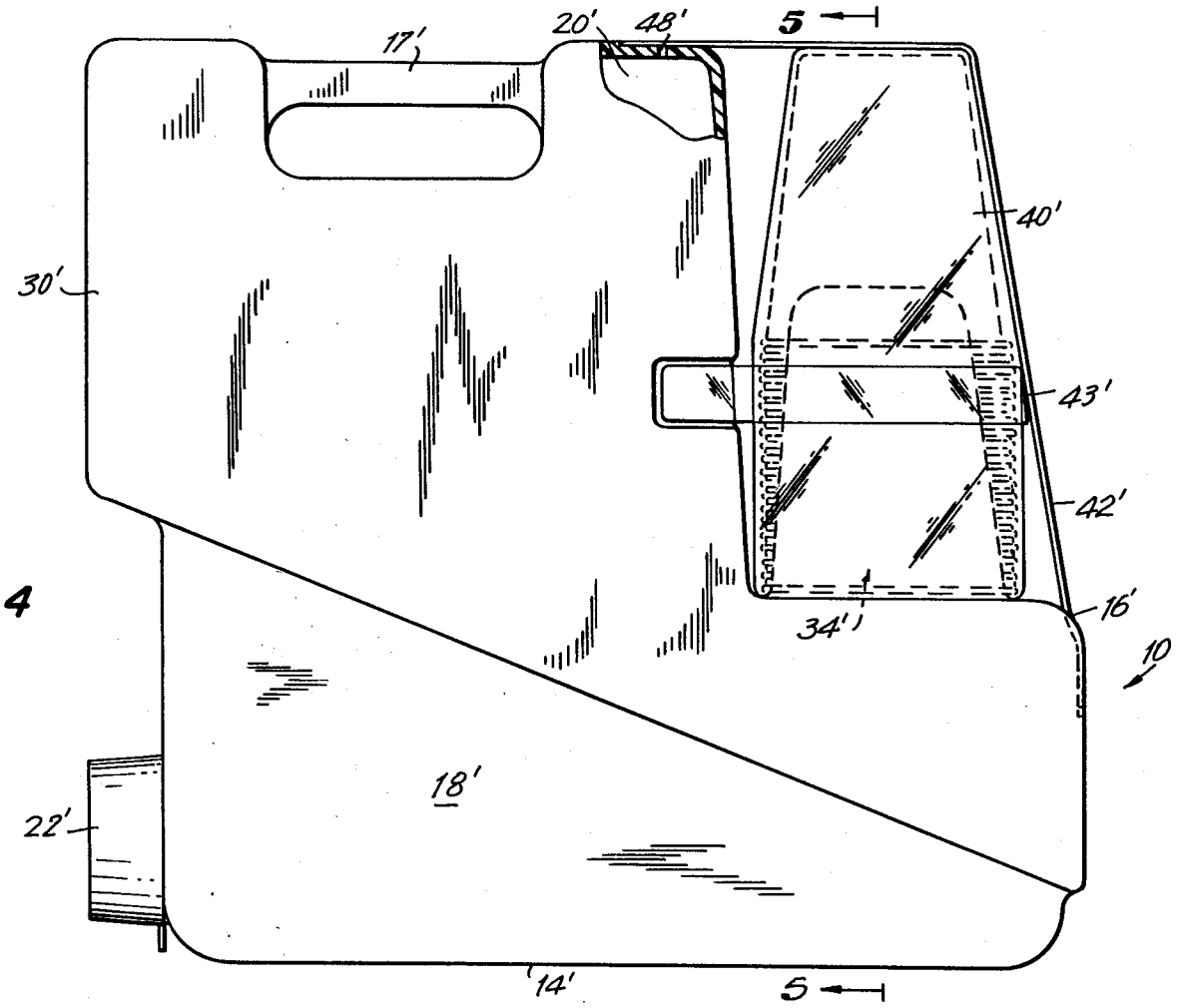
FIG. 4 is a side elevation of another embodiment assembly of the invention.

FIG. 4 is a side elevation of another embodiment assembly 10' of the invention where structures similar to those found in the assembly 10 are like-numbered, but with an added prime symbol. The embodiment assembly 10' of the invention differs essentially from the assembly 10 in that the legs (projections 30, 32) are not found and the projection 34' is upward from the end 14' of the container 12'. A projection 30' upward from end 16' functions in part to bear the hand grip 17' at its upper end and to extend the volume of chamber 20'. Also, the closure 22' is positioned at end 16' of the container 12'. A vent 48' opening is closed during times when beverage dispensing does not occur by the removable membrane 42', adhered to skin 18'.

The drinking cups 40' are mounted on the projection 34' and protected by the membrane 42' until use is desired. A removable tape 43' aids in securing the mebrane 42' and cups 40'.

Figure 5:
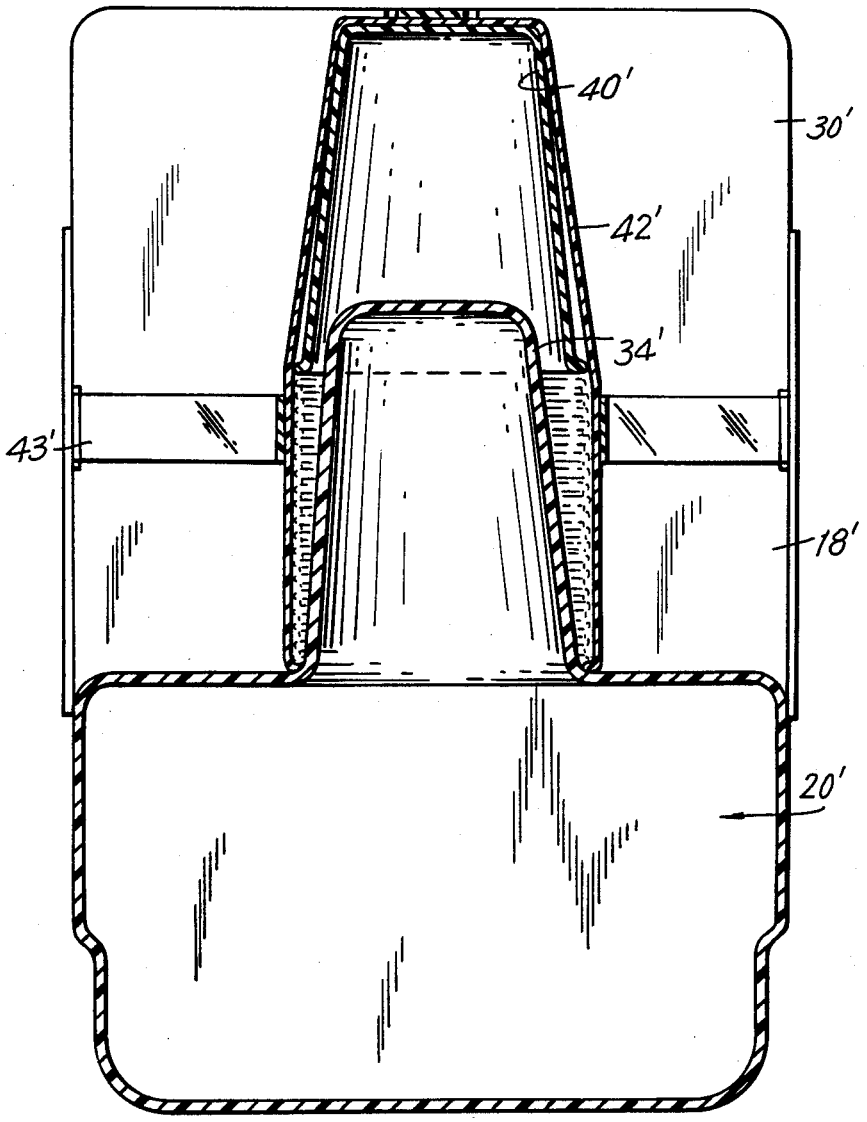
FIG. 5 is a view along lines 5—5 of FIG. 4.

FIG. 5 is a view along lines 5—5 of FIG. 4 and shows further detail.

Figure 6:
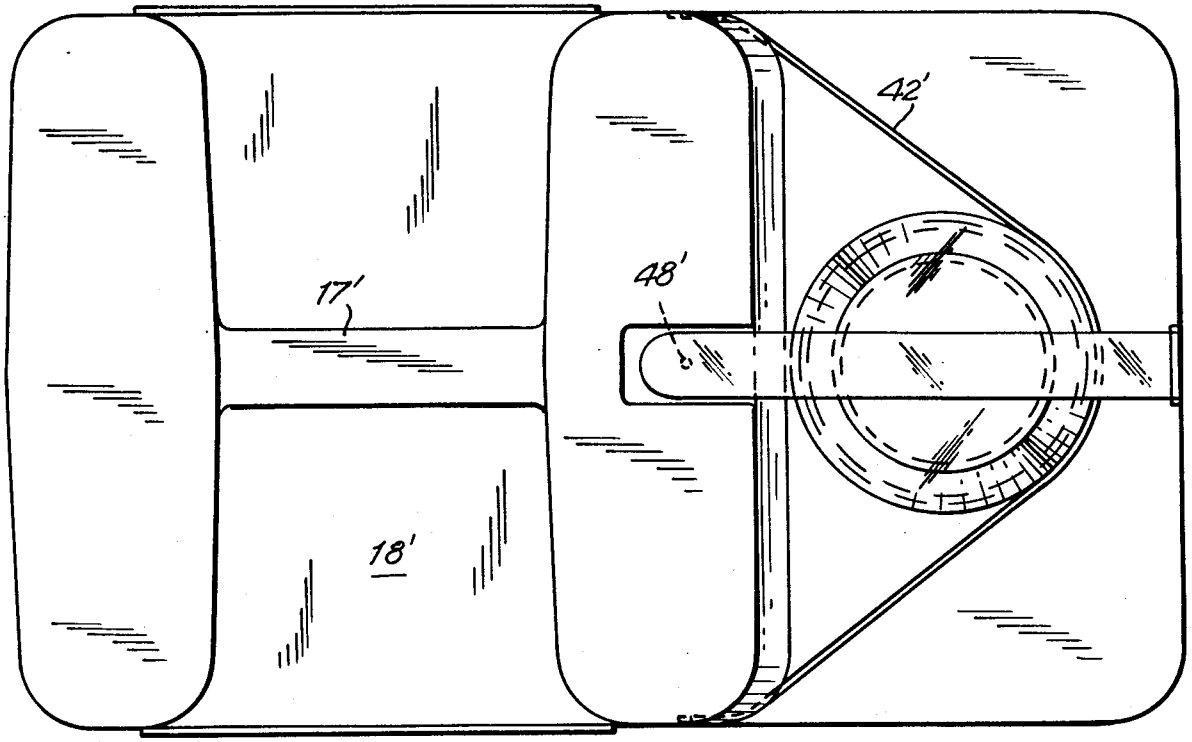
FIG. 6 is a top view of the embodiment assembly shown in FIG. 4.

FIG. 6 is a top view of the assembly shown in FIG. 4 and also shows further structural details.

FIG. 7 is a fragmentary view of a sidewall 52 of a preferred embodiment assembly of the invention wherein a sidewall of the assembly 10 or 10' includes a flexible panel feature. As specified above, the containers 10, 10' are fabricated from pressure deformable materials. Such containers, for example multilayer containers fabricated from synthetic polymeric resins are subject to partial or severe collapse under many conditions. Partial collapse includes the rupturing of any of the layers or the lack of adhesion between layers. Such failure renders the containers useless for many purposes. This collapse, partial or full, termed "paneling", occurs when the container walls are not sufficiently strong to resist deformation when there is a pressure differential between the container internally and externally. The deformation or collapse may even be severe enough to cause a rupture of the total container. The pressure differential can arise from gasses generated by the container contents, by post-treatment of the container and its sealed-in contents, by the development of a vacuum within the sealed container, etc. Vacuum can be generated within a container by the loss of contained material through the container walls or by cooling of the container contents after sealing. The degree of pressure differential which may develop is dependent on a number of variable factors such as temperature, volume of space or gas within the container, etc.

Vacuum may be a particular problem when the container is employed in a hot-fill application, i.e., when the material for containment is placed in the container while it is at a high temperature, in comparison to the storage temperature of the container. As the container contents cool, the content volume decreases at a greater rate than the plastic container, thereby creating a vacuum.

Heretofore, the problem of paneling has been dealt with by a number of means. For example, the use of deformation resisting design shapes (such as an hourglass shape, square or oval shape) may aid in reducing or masking paneling. Also, the use of highly rigid synthetic polymeric resins provide a resistance to paneling. Reverse-vented closure members have also been proposed to prevent a vacuum from forming within the container. However, these approaches are not always desirable for many reasons, including cost, aesthetics and convenience of use.

The container component of the present embodiment of FIG. 7 provides a method of controlling paneling of containers fabricated from synthetic polymeric resins, which otherwise would not resist paneling.

After filling and hermetically sealing the containers 10, 10' a pressure differential may develop in the container 10, 10' internally and externally for any of the reasons described above. The containers 10 and 10' will maintain their structural integrity, i.e., will resist paneling while responding to any pressure differential between the container internally and externally, by flexure of the container walls. This is a result of employing a specific structure as shown in the FIG. 7 where a plurality of flex panels 58, 60 are integrally joined together in a seamless joinder, by a hinge 62 and a hinge 64. The hinges 62, 64 are also inwardly projecting ribs, which function in two ways. First, the hinges 62, 64 permit the flex panels 58, 60 to independently flex inward toward chamber 20 or 20' and outwardly of chamber 20 or 20' in response to pressure differentials between the inside and outside of the respective containers 10, 10'. The hinges 62, 64 are pivot points for the flexure.

In addition, the hinges 62, 64 due to their rib configuration, strengthen the containers 10, 10' in a direction parallel to the vertical axis of the containers 10, 10'.

Further details of the flex panel structure may be seen in the FIG. 8, a view along lines 8—8 of FIG. 7. It will be seen that this construction is particularly advantageous in that the panels 58, 60 flex in a uniform manner so that the expansion or contraction of chamber 20 or 20' in volume in response to pressure differentials is hardly perceivable to the eye of one observing the containers 10, 10'. The container sidewalls are integrally molded in such a fashion as to allow panels 58, 60 to move flexibly in and out when the container is hot-filled and when internal vacuum is built up after product cools. The preferred hinge 64 is an arcuate section of the molded resin sandwiched between lateral expansion joints 70, 72 which will expand when the panels 58. 60 respond to pressure changes in the chambers 20,20'. This concept eliminates catastrophic paneling (sidewall cave in). The hinges 62, 64 are strength points which will only allow panels between these points to move uniformly. A critical area like the bottom pinch off in blown containers is relieved of added stress due to differential pressure when the flex panels 58, 60 are present. This container design aids in the production of lighter gram weight containers.

From the above description it will be appreciated that the container of the invention provides a means of controlling changes in the internal pressure which develops in synthetic, polymeric resin containers during and after packaging and post treatment, especially of food items. Both positive pressure and vacuum may develop and may be severe enough to distort, rupture or in other ways make unsealable such containers. The invention is particularly advantageous when the pressure differential which occurs is severe enough to cause paneling as described above. Traditionally, such containers have been made of metal or glass which provides sufficient strength even at high processing temperatures to resist the changes in pressure. The container of the invention provides a means of dealing with the pressure changes by compensating for the pressure deformation in an aestically acceptable manner, thus permitting the use of polymeric resin containers in a broad range of applications and designs. The invention is particularly advantageous for use in multi-layered polymeric resin containers. The multi-layer containers are subject to more pressure induced complications than a single layer wall design, as previously mentioned.

Those skilled in the art will appreciate that many modifications to the above-described preferred embodiments of the invention may be made without departing from the spirit and scope of the invention. For example, the embodiment of FIGS. 7 and 8 has been described above in relation to two hinge structures and two wall panels, separated by the hinges. Those skilled in the art will appreciate that additional hinges and panels may be incorporated in the container walls, dividing the walls into any number of flexible panels.

What is claimed is:

1. An assembly for the containment and dispensing of a beverage, which comprises;

(A) a hollow body of pressure deformable, synthetic polymeric resin, said body having 1. a first closed end;
2. a second closed end;
3. a continuous body skin joining the first and second ends, said skin being defined by and intermediate of an inner skin surface and an outer skin surface; and
4. a projected portion of the skin, restricted to a selected site on the body;

(B) a single closed chamber defined by the inner surface of the skin including the projected portion, for containment of the beverage;

(C) a port through the skin, providing fluid communication between the chamber and the outer surface of the skin;

(D) removable closure means mounted in the port, for opening and closing the fluid communication; and (E) a drinking vessel removably mounted on the outer skin surface of the projected portion of the skin.

2. The container of claim 1 having means to vent the chamber.

3. The container of claim 1 having an integrally molded hand grip means.

4. The container of claim 1 wherein a plurality of drinking vessels is mounted on the projection.

5. The container of claim 1 wherein the container is a blow molded container.

6. The assembly of claim 1 wherein the container body includes a skin portion which comprises;

a first, flexible panel and a second, flexible panel;

said first and second panels being integrally joined together in a seamless joinder, by first and second hinges between the joined edges of the first and second panels;

said first and second panels being pivotable on said hinges in response to pressure changes within and without the closed chamber.

7. The container of claim 2 wherein the hinges are ribs projecting inwardly towards the chamber.

* * * * *